US005818118A

United States Patent [19]

Kimura et al.

[11] Patent Number: 5,818,118

[45] Date of Patent: Oct. 6, 1998

[54] ENGINE STARTER SYSTEM HAVING AN IMPROVED PINION ASSEMBLY

[75] Inventors: Eiichi Kimura, Gunma-ken; Shinichi Nagashima, Tochigi-ken; Mitsuhiro Kogure, Gunma-ken; Michio Okada, Gunma-ken; Koji Nara, Gunma-ken, all of Japan

[73] Assignee: Mitsuba Corporation, Japan

[21] Appl. No.: 654,065

[22] Filed: May 28, 1996

[30] Foreign Application Priority Data

May 29, 1995 [JP] Japan ..... 7-153819

[51] Int. Cl.[6] ..... F02N 11/00

[52] U.S. Cl. ..... 290/48; 74/6; 74/76

[58] Field of Search ..... 290/38 A, 38 B, 290/38 C, 38 R, 48; 74/6, 7 A, 7 R, 7 E, 7 C; 310/78

[56] References Cited

U.S. PATENT DOCUMENTS 4,843,897 7/1989 Tallis, Jr. ..... 74/6

5,111,705 5/1992 Isozumi ..... 74/6

FOREIGN PATENT DOCUMENTS 1-208564 8/1989 Japan .

*Primary Examiner*—Thomas M. Dougherty

*Assistant Examiner*—Judson H. Jones

*Attorney, Agent, or Firm*—Skjerven, Morrill, MacPherson, Franklin & Friel LLP; Alan H. MacPherson

[57] ABSTRACT

In an engine starter comprising a pinion slidably fitted on the output shaft for driving a ring gear of an engine that is to be started, and a one-way clutch having a first end secured to the pinion and a second end which is engaged by the output shaft via spline means, a compression coil spring is interposed between a stopper secured to the output shaft and an annular shoulder defined in a cylindrical extension of the second end of the one-way clutch. Therefore, even when the pinion is forced into a high speed rotation by the engine which has been started by the engine starter, the pinion simply rotates freely, and no friction is applied to the compression coil spring or the stopper. Also, by receiving the compression coil spring in an annular space defined between the cylindrical extension of the second end of the one-way clutch and the output shaft, the compression coil spring can be protected from the centrifugal force which acts upon the compression coil spring when the output shaft of the engine starter rotates at an extremely high speed.

6 Claims, 2 Drawing Sheets

1
2
3
4
5
6
7
8
9
10
11
12
13
14
15
16
17
18
18a
19
20
21
22
23
24
25
25a
26
27
27a
28
29
30
31
31a
32
33
34
35
36
37
40
41
43
43a
44
45
II
II

ENGINE STARTER SYSTEM HAVING AN IMPROVED PINION ASSEMBLY

TECHNICAL FIELD

The present invention relates to an engine starter system, and in particular to an engine starter system having an improved pinion assembly which is both compact and durable.

BACKGROUND OF THE INVENTION

In conventional engine starters, it has been customary to connect the pinion, which is adapted to mesh with the ring gear of an engine by being axially actuated by a solenoid device, to the output shaft of the engine starter via a one-way clutch, and spline means, and an example of such an engine starter is proposed in Japanese patent laid-open publication (kokai) No. 1-208564. According to such a conventional coaxial engine starter, a stopper is provided at a free end of the output shaft to limit the projecting length of the pinion, and a return spring, consisting of a compression coil spring, is interposed between the stopper and the pinion to restore the pinion back to a stand-by position.

When the ignition switch is turned to the start position, the pinion is thrown out to mesh with the ring gear, and the electric motor is turned to start the engine. At this point, the pinion and the output shaft rotate integrally with each other. As soon as the engine is started, the pinion is driven by the engine. A one-way clutch is interposed between the output shaft and the pinion to allow the pinion to freely rotate. At this point, a speed difference exists between the output shaft which is driven by the electric motor and the pinion which is driven by the engine, and a friction is generated in the parts of sliding engagement between the stopper provided on the output shaft, the return spring and the pinion.

If the return spring for biasing the pinion toward the stand-by position is forced into rotation by the pinion, particularly when it is driven by the engine, at a high speed, the centrifugal force acting upon the spring may apply an excessive radial expanding force on the spring, and it could damage the return spring.

BRIEF SUMMARY OF THE INVENTION

In view of such problems of the prior art, a primary object of the present invention is to provide an improved engine starter which can avoid wear to the stopper and the return spring which engages the pinion so as to limit the projecting length of the pinion.

A second object of the present invention is to provide an engine starter which can avoid any damage to the return spring for the pinion even when the pinion is forced into a high speed rotation by the engine.

A third object of the present invention is to provide an engine starter which is provided with a highly compact pinion assembly.

According to the present invention, these and other objects can be accomplished by providing an engine starter, comprising: an electric motor mounted to a casing; an output shaft disposed in the casing and adapted to be rotatably driven by the electric motor; a pinion slidably fitted on the output shaft for driving a ring gear of an engine that is to be started; a one-way clutch having a first end secured to the pinion and a second end which is engaged by the output shaft via spline means; a solenoid device for selectively and axially driving the pinion in an axial direction; and return spring means interposed between a stopper engaged by the output shaft and the second end of the one-way clutch.

According to this structure, the projecting length of the pinion can be limited by limiting the axial displacement of the part of the one-way clutch which rotates integrally with the output shaft or by the part which is not affected by the rotational speed of the pinion. In particular, because one end of the return spring means is engaged by the part of the one-way clutch rotationally fast with the output shaft, and the other end of the return spring means is engaged by the stopper provided on the output shaft, the return spring means can bias the pinion toward its stand-by position without contacting the pinion. Therefore, the return spring means, which typically consists of a compression coil spring, as well as the stopper, is free from any friction, and this contributes to increasing the durability of the engine starter.

According to a preferred embodiment of the present invention, the second end of the one-way clutch comprises a cylindrical extension having an annular shoulder which engages one end of the compression coil spring, the compression coil spring being substantially received in an annular space defined between the cylindrical extension and the output shaft at least when the pinion is thrown out into an operative position and the compression coil spring is compressed. Thus, even when the compression coil spring is forced into a high speed rotation by the engine which has been started by the engine starter, it is protected from being excessively expanded in the radial direction due to the centrifugal force acting upon it. Also, by appropriately receiving the compression coil spring within the axial expanse of the one-way clutch, the engine starter can be made highly compact, and, particularly, its axial dimension can be reduced.

The one-way clutch typically comprises a clutch inner member which is integrally formed with the pinion, a clutch outer member having the cylindrical extension integrally formed therewith, and roller means arranged between the clutch inner and outer members.

The axial end of the cylindrical extension remote from the pinion may define an annular end surface upon which a shifter member for axially actuating the pinion selectively, and this structure is particularly advantageous when the solenoid device for actuating the pinion consists of a coaxial arrangement employing an armature and an electromagnetic coil which are both annular and surround the output shaft. By setting the axial stroke of the shifter so as to define a gap between the shifter member and the cylindrical extension when the pinion is fully thrown out into the operative position, it is possible to minimize friction and wear in the mutually abutting parts of the shifter member and the cylindrical extension of the second end of the one-way clutch.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
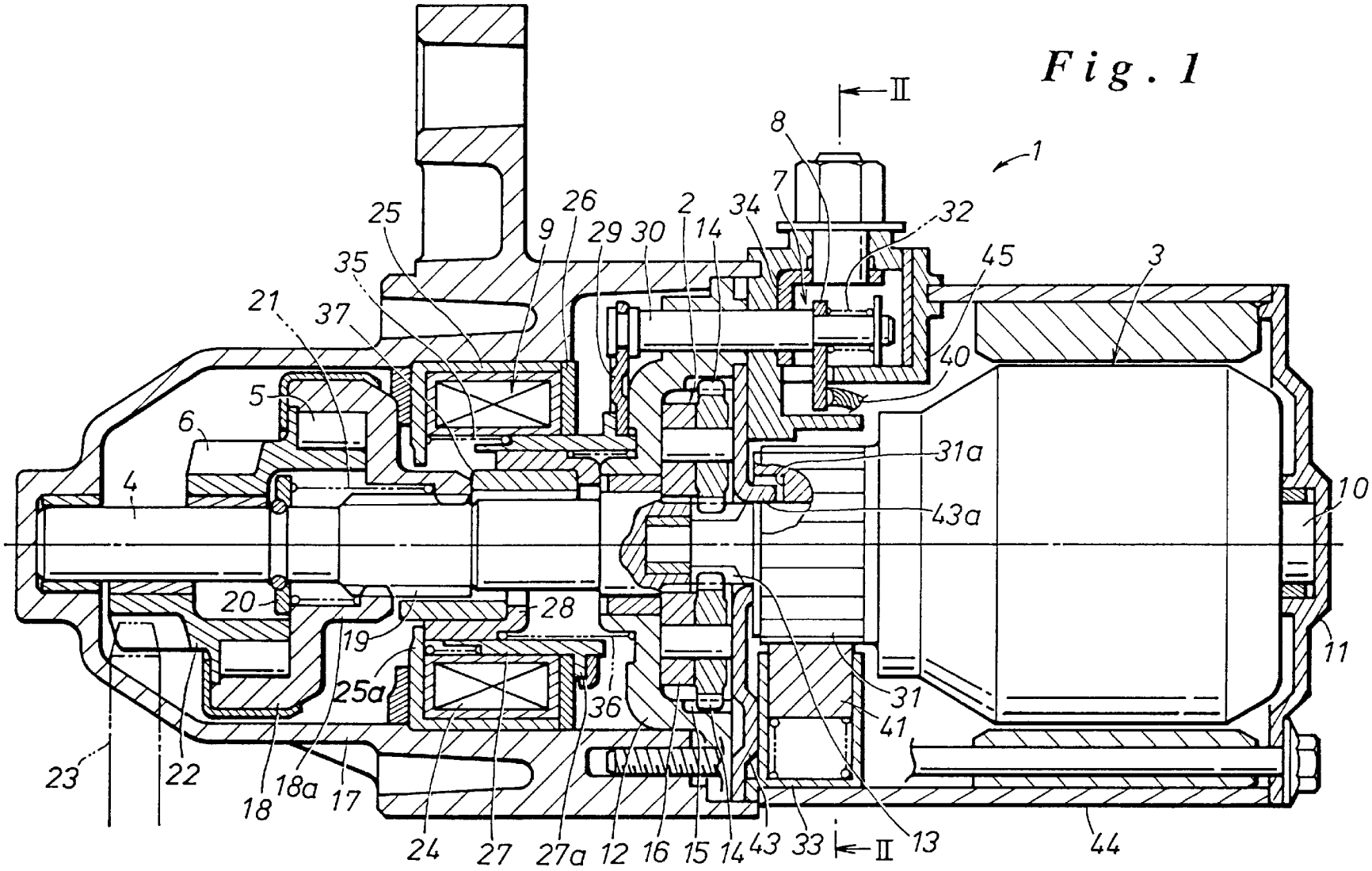
FIG. 1 is a sectional view of a first embodiment of the coaxial engine starter according to the present invention, the upper half of the drawing showing the rest condition of the starter while the lower half showing the operative condition of the engine starter.

FIG. 1 generally illustrates an engine starter equipped with a reduction gear unit which is constructed according to the present invention, and the upper half of the drawing illustrates the starter at its inoperative state while the lower half of the drawing illustrates the starter at its operative state. This starter 1 produces a torque which is necessary for starting an internal combustion engine, and comprises an electric motor 3 equipped with a planetary gear reduction gear unit 2, an output shaft 4 connected to the electric motor 3 via the reduction gear unit 2, a one-way roller clutch 5 and a pinion 6 which are slidably mounted on the output shaft 4, a switch unit 7 for selectively opening and closing the electric power line leading to the electric motor 3, and a solenoid device 9 for axially moving a moveable contact 8 of the switch unit 7 as well as the pinion 6.

The electric motor 3 consists of a known commutator type DC electric motor, and its rotor shaft 10 is pivotally supported a central recess of a bottom plate 11 at its right end, and pivotally supported in a central recess provided in a right end surface of the output shaft 4, which is coaxially disposed with respect to the rotor shaft 10, at its left end. The bottom plate 11 closes a right end of a cylindrical motor casing 44.

The reduction gear unit 2 is provided in a recess defined on the inner surface of the top plate 12 of the electric motor 3 which closes the left end of the motor casing 44. The reduction gear unit 2 comprises a sun gear 13 which is formed in a part of the rotor shaft 10 adjacent to the output shaft 4, a plurality of planetary gears 14 meshing with the sun gear 13, and an internal teeth ring gear 15 formed along the outer periphery of the recess defined on the inner surface of the top plate 12 to mesh with the planetary gears 14. A support plate 16 supporting the planetary gears 14 is attached, by press fitting, to the right end of the output shaft 4 which is pivotally supported in a central opening of the top plate 12.

To the top plate 12 is attached a pinion housing 17 which also serves as a securing bracket for mounting the starter to the engine. The left end of the output shaft 4 is pivotally supported in a central recess defined on the inner surface of the left wall of the pinion housing 17.

The outer circumferential surface of a middle part of the output shaft 4 engages the inner circumferential surface of a clutch outer member 18 of the one-way roller clutch 5 via a helical spline 19. The clutch outer member 18 is normally urged to the right by a return spring 21 interposed between an annular shoulder 18*b* defined in a cylindrical sleeve 18*a* extending from the clutch outer member 18 toward the electric motor 3 and a stopper plate 20 secured to a left end portion of the output shaft 4. The right extreme end of the cylindrical sleeve 18*a* engages with the helical spline 19 formed in the output shaft. The return spring 21 is received in an annular gap defined between the inner circumferential surface of the sleeve 18*a* extending from the clutch outer member 18 and the outer circumferential surface of the output shaft 4. By so doing, the return spring 21 is disposed inside the one-way roller clutch 5, and the axial dimension of the assembly can be minimized.

The clutch outer member 18 engages a clutch inner member 22 of the one-way roller clutch 5 in an axially fast but rotationally free relationship (which depends on the direction of relative rotation). The outer circumferential surface of the left end of the clutch inner member 22 is integrally formed with the aforementioned pinion 6 which meshes with the ring gear 23 of the engine to drive the same. The clutch inner member 22 integrally formed with the pinion 6 is fitted on the left end of the output shaft 4 in a both rotationally and axially free relationship.

In an intermediate part of the pinion housing 17 is secured an energization coil 24 which surrounds the output shaft 4 made of non-magnetic material such as stainless steel. The energization coil 24 is surrounded by a yoke defined by a cup-shaped holder 25 having an internal flange 25*a* surrounding the output shaft 4 and an annular disk 26. In a gap defined between the inner circumferential surface of the energization coil 24 and the outer circumferential surface of the output shaft 4 is disposed an armature outer member 27 and an armature inner member 28, both made of ferromagnetic material, in a mutually coaxially nested and axially slidable relationship. The left ends of the armature members 27 and 28 oppose the axially inner surface of a central part of the internal flange 25*a* of the holder 25, and the central part of the internal flange 25*a* serves as a magnetic pole for the armature members 27 and 28. By thus making the output shaft 4 received in the solenoid device 9 from non-magnetic material, the magnetic path is concentrated in the armature, and the air gap between the armature and the output shaft can be virtually eliminated so that the radial dimension of the solenoid device 9 can be minimized.

The first part of the armature or the armature outer member 27 is connected at its right end to a connecting plate 29, and, via a connecting rod 30 passing through the top plate 12 of the electric motor 3, to the moveable contact 8 of the switch unit 7 placed adjacent the commutator 31 of the electric motor 3. The moveable contact 8 is mounted to the connecting rod 30 in an axially moveable manner, and is supported by a coil spring 32 in a floating relationship so as to be selectively engaged to and disengaged from a fixed contact 34 of the switch unit 7 which is fixedly secured to a brush stay 33 provided around the commutator 31. In other words, the moveable contact 8 is liked to the armature outer member 27 via a lost motion mechanism. The armature outer member 27 is always urged to the right by a return spring 35 interposed between the armature outer member 27 and the internal flange 25*a* provided in the holder 25 of the energization coil 24, but is normally at its neutral or rest position separating the moveable and fixed contacts from each other.

The second part of the armature or the armature inner member 28 is always urged to the left with respect to the top plate 12 by a coil spring 36 which is weaker that the return spring 21 of the clutch outer member 18. The armature inner member 28 is connected to a shifter member 37 made of non-magnetic material having a left end engaging the annular end surface 18*c* defined at the right end of the clutch inner member 22.

By thus separating the armature into the armature inner member 27 for driving the moveable contact 8 and the armature outer member 28 for driving the pinion 6 which are allowed to move individually, no space is needed in axially front and rear portions of the energization coil 24, and the axial dimension of the solenoid device can be minimized.

A gap is defined between the opposing end surfaces of the clutch outer member 18 and the shifter member 37 so as to prevent them from contacting each other when the pinion 6 is fully meshed with the ring gear 23. This gap is preferably no more than one half the meshing overlap between the pinion 6 and the ring gear 23. The energization coil 24 is electrically connected to an ignition switch not shown in the drawing via a connector 38 (see FIG. 2) provided in the switch unit 7.

Figure 2:
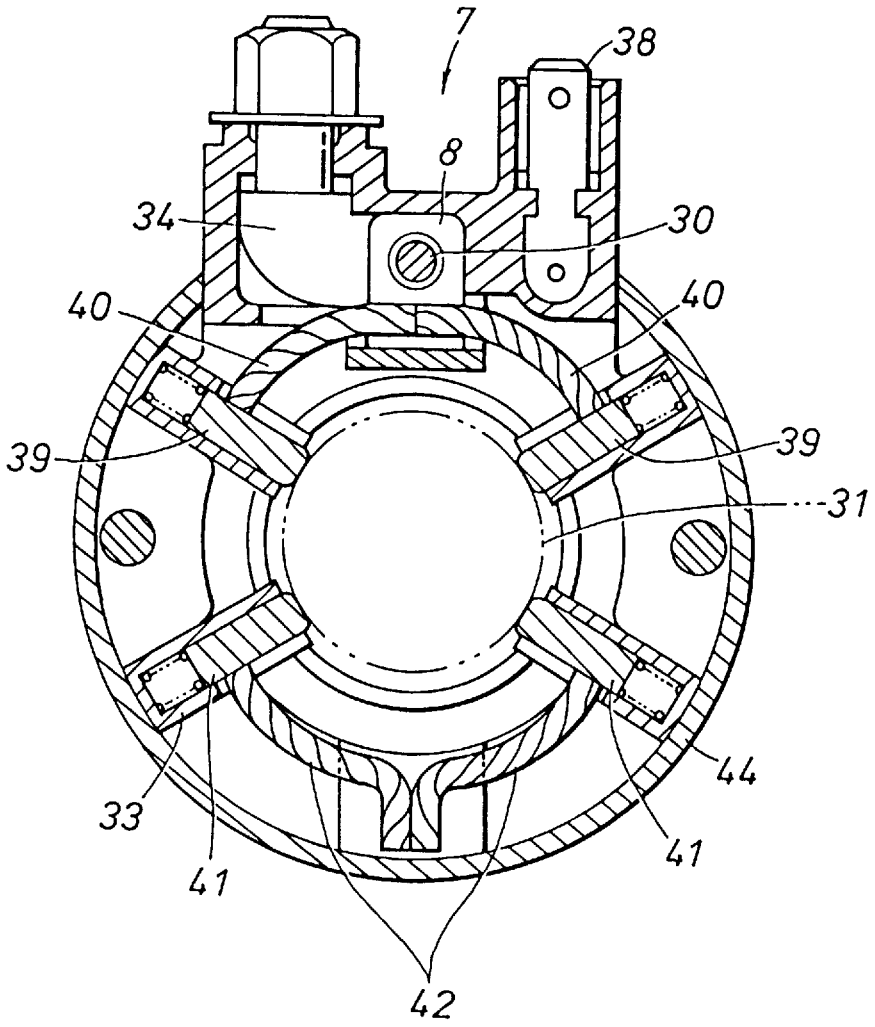
FIG. 2 is a sectional view taken along line II—II of FIG. 1.

The fixed contact 34 of the switch unit 7 is electrically connected to the positive terminal of a battery not shown in the drawings, and a pair of pigtails 40 connected to a pair of positive pole brushes 39 are attached to the fixed contact 34 by spot welding also as illustrated in FIG. 2. A pair of negative pole brushes 41 are provided in a linesymmetrically opposing positions with respect to the positive pole brushes 39. The pigtails 42 for these negative pole brushes 41 are connected to a center plate 43 which is described hereinafter, and is connected to the negative terminal of the battery via the pinion housing 17 and the vehicle body which is not shown in the drawings. The switch unit 7 is provided in a space flanked by the positive pole brushes 39. By so doing, the connecting terminals leading to the battery and the pigtails 40 of the positive brushes 39 can be selectively connected by the single moveable contact 8 and the single fixed contact 34 so that the number of component parts for the switch unit 7 can be reduced, and the dimensions in both radial and axial directions can be reduced. The brushes 39 and 41 are supported in a known manner by a brush stay 33 which is made of electrically insulating material.

An annular metallic center plate 43 is interposed between the brush stay 33 and the top plate 12 to separate the reduction gear unit 2 from the electric motor 3. A central part of the center plate 43 is provided with a cylindrical portion 43*a* which projects toward the commutator 31 with its inner circumferential surface receiving the outer circumferential surface of the rotor shaft 10 defining a small gap therebetween. The free end of the cylindrical portion 43*a* is received in a recess 31*a* formed in an axial end surface of the commutator 31 to prevent grease from leaking out of the reduction gear unit 2 to the commutator 31.

The switch unit 7 is located at a top part of the starter 1, and the contacts, or the fixed contact 34 secured to the brush stay 33 and the moveable contact 8, are covered by the brush stay 33 and a switch cover 45 to prevent any particulate foreign matters that may be produced from the brushes from getting into the switch unit 7.

Now the operation of the above described embodiment is described in the following. In the inoperative condition, because no electric current is supplied to the energization coil 24, the armature outer member 27 is at its rightmost condition under the spring force of the return spring 35, and the moveable contact 8 which is connected to the armature outer member 27 is spaced from the fixed contact 34. At the same time, the clutch outer member 18 which is urged by the return spring 21 is at its rightmost position along with the clutch inner member 22 which is integral with the pinion 6, the shifter member 37 and the armature inner member 28 with the result that the pinion 6 is disengaged from the ring gear 23.

When the ignition switch is turned to the engine start position, electric current is supplied to the energization coil 24 to magnetize the same. As a result, a magnetic path for conducting a magnetic flux is established in the armature inner and outer members 27 and 28 thereby moving the armature inner and outer members 27 and 28 to the left. The armature outer member 27, as it is closer to the central part (pole) of the internal flange 25*a* of the holder 25 than the armature inner member 28, moves before the armature inner member 28 does. As a result, the moveable contact 8 is moved to the left by the armature outer member 27 via the connecting plate 29 and connecting rod 30, and comes into contact with the fixed contact 34. This in turn causes the electric power of the battery to be supplied to the electric motor 3, and the rotor shaft 10 to be turned. Because the moveable contact 8 comes into contact with the fixed contact 34 before the armature outer member 27 moves its full stroke, and the moveable contact 8 is mounted on the connecting rod 30 in an axially floating relationship, the pressure of the coil spring 32 is applied between the two contacts 8 and 34. At this point, the armature outer member 27 comes to a stop with a certain gap defined between the left end surface of the armature outer member 27 and the central part of the internal flange 25*a* because of the presence of a stopper integrally formed at the right end of the armature outer member 27 as an external flange 27*a* comes into contact with the annular disk 26.

As the rotor shaft 10 turns, this rotation is reduced in speed by the reduction gear unit 2, and is transmitted to the output shaft 4. Because of the inertia of the clutch outer member 18 which engages with the output shaft 4 via the helical spline 19, the axial force owing to the helical spline 19 is applied to the clutch outer member 18, causing it to move to the left. At the same time, the armature inner member 28, which is subjected to the leftward attractive force by the energization coil 24 and the pressure from the coil spring 36, starts moving to the left. This force is applied to the clutch outer member 18 as an axial force via the shifter member 37. In this case, it is preferable for the electric motor to start turning before the armature inner member 28 or the shifter member 37 comes into contact with the clutch outer member 28 in view of reducing the required output of the energization coil 24. However, it is within the purview of the present invention to appropriately and freely otherwise select the timing of the start of the rotation of the electric 3 and the subsequent actuation of the helical spline 19 in relation with the axial engagement between the shifter member 37 and the clutch outer member 28 depending on the output available from the energization coil 24.

This axial force pushes the clutch outer member 18 leftward against the biasing force of the return spring 21, and the pinion 6, which is integral with the clutch inner member 22 and is therefore integrally engaged with the clutch outer member 18, is also pushed leftward. Once the clutch outer member 18 engages with the stopper plate 20, and the pinion 6 comes into full mesh with the ring gear 23, the rotation of the output shaft 4 is transmitted to the ring gear 23, and starts the engine. At this point, the left end surface of the armature inner member 28 engages the central part of the internal flange 25*a* of the holder 25, and a small gap is defined between the left end surface of the shifter member 37 which has integrally moved with the armature inner member 28 and the clutch outer member 18. Because the armature inner member 28 receives a maximum attractive force of the energization coil 24 as it engages the central part of the internal flange 25*a* of the holder 25, even when the pinion 6 is subjected to a force which tends to disengage it from the ring gear 23, the rightward movement of the clutch outer member 18 is prevented by the shifter member 37, and the pinion 6 is prevented from dislodging from the ring gear 23.

The electric current that is required to keep the armature inner and outer members 27 and 28 stationary after they have moved the full stroke is substantially smaller than that required for starting the movement of the armature inner and outer members 27 and 28. In other words, by making use of the axial force owing to the helical spline 19 for starting the movement of the one-way roller clutch 5 including the pinion 6, the output requirement of the energization coil 24 can be reduced, and the size of the energization coil 24 can be accordingly reduced.

A gap is defined between the opposing end surfaces of the clutch outer member 18 and the shifter member 37, and this gap minimizes the time of contact between the clutch outer member 18 and the shifter member 37 so as to minimize the friction between them and hence the wear of the associated parts. Because this gap is sufficiently smaller than the meshing overlap between the pinion 6 and the ring gear 23 (for instance, no more than one half the overlap), any premature disengagement between them can be avoided.

Once the engine has started and the rotational speed of the engine exceeds that of the pinion 6, the pinion 6 will start turning freely by virtue of the one-way roller clutch 5 in the same manner as in the conventional engine starter.

When the supply of electric current to the energization coil 24 ceases, owing to the biasing force of the return spring 21 acting upon the clutch outer member 18 and the biasing force of the return spring 34 acting upon the armature outer member 27, the pinion 6 is disengaged from the ring gear 23 and the moveable contact 8 is separated from the fixed contact 32, thereby stopping the electric motor 3.

Conventionally, as described above, because the stopper for limiting the projecting length of the pinion and the return spring for biasing the pinion to its stand-by position rotate relative to the pinion which can be driven by the engine, when the pinion freely rotates, a friction may generate between the stopper, the return spring and the pinion, causing a wear in mutually sliding parts. Also, the spring may follow the movement of the pinion which may freely rotate at a high speed, the resulting centrifugal force acting upon the return spring could damage it. On the other hand, according to the present invention, the projecting length can be limited by a member which is not related to the freely rotating pinion, and the contact between the return spring and the pinion can be avoided. Therefore, according to the present invention, a significant improvement in the durability of the stopper and the pinion can be achieved. Furthermore, by placing the stopper and the return spring consisting of a compression coil spring inside the one-way clutch as shown in the above described embodiment, an efficient utilization of space can be achieved, and the axial dimension of the engine starter can be effectively reduced. Also, by radially restraining the compression coil spring by the inner circumferential surface of the second end of the one-way clutch, any excessive radial expansion of the compression coil spring can be avoided even when the output shaft is forced to rotate at a high speed.

Although the present invention has been described in terms of a specific embodiment thereof, it is possible to modify and alter details thereof without departing from the spirit of the present invention.

What we claim is:

1. An engine starter, comprising:

an electric motor mounted to a casing;

an output shaft disposed in said casing and adapted to be rotatably driven by said electric motor;

a pinion slidably fitted on said output shaft for driving a ring gear of an engine that is to be started;

a one-way clutch having a first end secured to said pinion and a second end which is engaged by said output shaft via spline means;

a solenoid device for selectively and axially driving said pinion in an axial direction; and return spring means interposed between a stopper engaged by said output shaft and said second end of said one-way clutch.

2. An engine starter according to claim 1, wherein said return spring means consists of a compression coil spring.

3. An engine starter according to claim 2, wherein said second end of said one-way clutch comprises a cylindrical extension having an annular shoulder which engages one end of said compression coil spring, said compression coil spring being substantially received in an annular space defined between said cylindrical extension and said output shaft at least when said pinion is thrown out into an operative position and said compression coil spring is compressed.

4. An engine starter according to claim 3, wherein said one-way clutch comprises an clutch inner member which is integrally formed with said pinion, a clutch outer member having said cylindrical extension integrally formed therewith, and roller means arranged between said clutch inner and outer members.

5. An engine starter according to claim 3, wherein an axial end of said cylindrical extension remote from said pinion defines an annular end surface upon which a shifter member for axially actuating said pinion selectively abuts.

6. An engine starter according to claim 5, wherein an axial stroke of said shifter member is defined so as to define a gap between said shifter member and said cylindrical extension when said pinion is fully thrown out into said operative position.

* * * * *